US005085155A

United States Patent [19]

Ballard

[11] Patent Number: 5,085,155

[45] Date of Patent: Feb. 4, 1992

[54] SHELF ASSEMBLY

[76] Inventor: Donald M. Ballard, 16700 Tinker Pl., Huntersville, N.C. 28078

[21] Appl. No.: 737,249

[22] Filed: Jul. 29, 1991

[51] Int. Cl.[5] ..... A47B 3/00

[52] U.S. Cl. ..... 108/111; 403/231

[58] Field of Search ..... 108/111, 110, 107, 106, 108/153; 211/135, 153; 403/231, 382

[56] References Cited

U.S. PATENT DOCUMENTS

| | | | |
|---|---|---|---|
| 870,681 | 11/1907 | Kargos | 108/106 |
| 3,341,027 | 9/1967 | Mackin, Jr. et al. | 108/106 X |
| 3,351,313 | 11/1967 | Guillon | 108/106 X |
| 3,549,019 | 12/1970 | Wood et al. | 211/135 |
| 3,901,012 | 8/1975 | Canin | 403/231 X |
| 3,924,956 | 12/1975 | Fortier | 403/387 X |
| 4,067,161 | 1/1978 | Ronsch | 108/111 X |
| 4,709,642 | 12/1987 | Briosi | 108/111 |
| 4,712,942 | 12/1987 | Bronn | 403/23 X |
| 4,875,418 | 10/1989 | Moeckl et al. | 108/111 X |

*Primary Examiner*—Jose V. Chen
*Attorney, Agent, or Firm*—Clifton Ted Hunt

[57] ABSTRACT

A three dimensional shelf assembly is provided with three planar components and two tubular components. The planar and tubular shelf components can be manufactured and shipped before being assembled into three dimensional shelves, thereby avoiding the expense of shipping three dimensonal shelves.

6 Claims, 2 Drawing Sheets

SHELF ASSEMBLY

FIELD OF THE INVENTION

This invention relates to shelving and, while its utility is not so limited, is adapted for plastic shelving of the type used for displaying merchandise, as in department stores.

BACKGROUND OF THE INVENTION

Shelving for displaying merchandise in department stores is commonly made from a suitable transparent plastic, such as acrylic. A typical unit of the type with which the present invention is intended to be used has a support structure or frame with vertical support members to which individual shelves are connected. Each individual shelf is commonly formed, molded, or glued into a three-dimensional shape of a desired width and length from panels of a suitable transparent plastic.

The three-dimensional shape of the shelf is commonly a U-shaped configuration with a horizontal base, a vertical lip at the front of the shelf and a vertical wall at the back of the shelf; or an L-shaped configuration with a horizontal base and either a vertical lip at the front of the shelf or a vertical wall at the back of the shelf. The three-dimensional shape of the shelf is advantageous in retaining merchandise on the shelf, and desirably strengthens the shelf to support the merchandise.

The three-dimensional shelves are assembled within the support structure, or frame, and are supported in spaced parallel relation to each other by gluing, or mechanically fastening the shelves to the support structure to form a display fixture. Alternatively, the shelves may be supported in spaced parallel relation to each other within the support structure by a pair of rods beneath each shelf. The rods are usually formed from tubular metal extending between and connected to the vertical support members.

Shelving of this type is generally satisfactory from a utilitarian standpoint, but the three-dimensional shelves cannot be broken down for shipping and the consequent expense of freight when shipping the shelving over long distances is unsatisfactory to the point that nationwide distribution of display shelving is economically impracticable.

SUMMARY OF THE INVENTION

The present invention provides an improved three-dimensional shelf having components that are manufactured in planar and tubular configurations. The components can be readily assembled into a three-dimensional shelf and disassembled when desired.

The planar and tubular components of the shelf can be manufactured and shipped in knockdown or unassembled condition and easily assembled with other like shelves at the site of use as three-dimensional shelves within a support structure to provide a display cabinet. The assembled three-dimensional shelves have the same utilitarian and structural advantages as the prior art monolithic three-dimensional shelves that can not be broken down for shipment.

The planar components of the improved shelf are formed of acrylic or other desired material of predetermined cross-sectional dimensions with a groove extending in inwardly spaced relation to selected longitudinal edges of the panel. Each shelf has three such planar components: one for the base of the shelf; one for the lip at the front of the shelf; and one for the wall at the rear of the shelf.

The tubular components are two like pieces of a unique metal profile. The profile is formed by extruding metal, such as aluminum, in a tubular configuration with flanged channels that retain the planar components of the shelf to form a three-dimensional shelf. The metal profiles of the shelf are internally threaded at each end to receive bolts that fasten the three-dimensional shelves to supporting end panels.

DETAILED DESCRIPTION OF THE INVENTION

Figure 4:
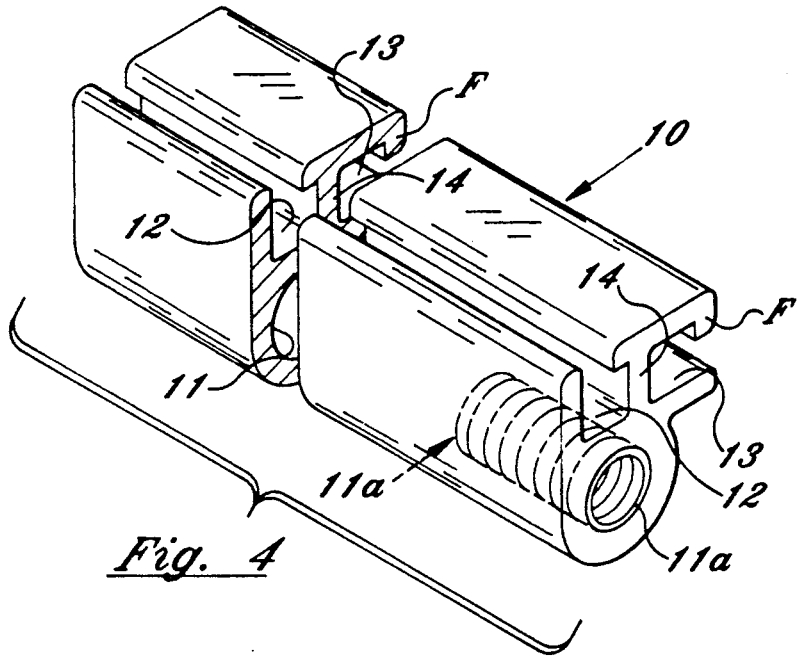
FIG. 4 is a perspective view, partially in section, of one of the supporting rods shown in FIG. 3, showing internal threads, which are typical of each end.
Figure 5:
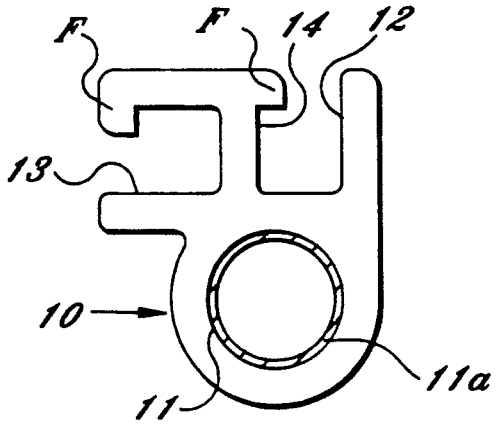
FIG. 5 is an end view of the rod and fastener element shown in FIG. 4.

Referring more specifically to the drawings, the numeral 10 broadly indicates the metal profile used in the present invention. The profile 10 is preferably formed of extruded metal of tubular construction with an axial bore 11. Both ends of the bore 11 may be internally threaded as at 11A to provide fastener elements. Perpendicularly disposed channels 12 and 13, separated by a common wall 14, are formed above the bore 11 and extend longitudinally along the full length of the profile 10 (FIG. 4). A flange F extends inwardly of each channel 12 and 13.

Figure 3:
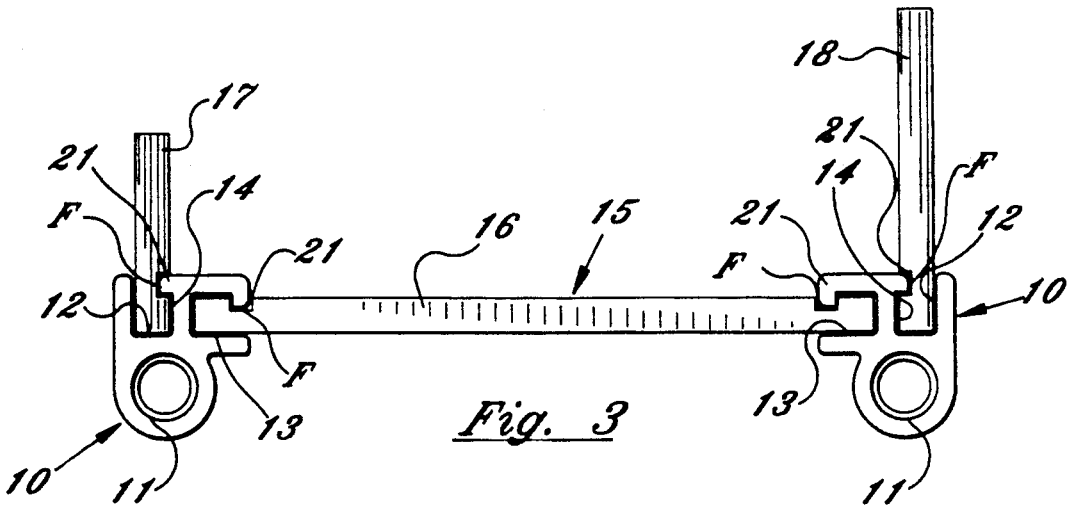
FIG. 3 is an end view of a shelf integrated with its supporting rods according to the invention.

As best seen in FIG. 3, each shelf, broadly indicated at 15, consists of five components. Three of the components of the improved three-dimensional shelf are of a planar configuration and two of the components are of a unique tubular configuration. In the illustrated embodiment, the planar components consist of a base 16 of the shelf 15, its front wall or lip 17, and its rear wall 18.. The front wall 17 and rear wall 18 are coextensive in length with the base 16 of the shelf 15 and are shown to be parallel with each other and perpendicular to the base 16, although the walls 17 and 18 may extend at any desired angle to the base 16. Some shelves may consist of only two planar components, a horizontal base 16 and either the lip 17 or the wall 18. The tubular components are two lengths of the unique tubular profile 10.

Each planar component of the shelf 15 is grooved as at 21 in inwardly spaced relation to at least one longitudinal edge of the component to receive the inwardly extending flange F of its respective channel 12 or 13 in one of the profiles 10.

Figure 1:
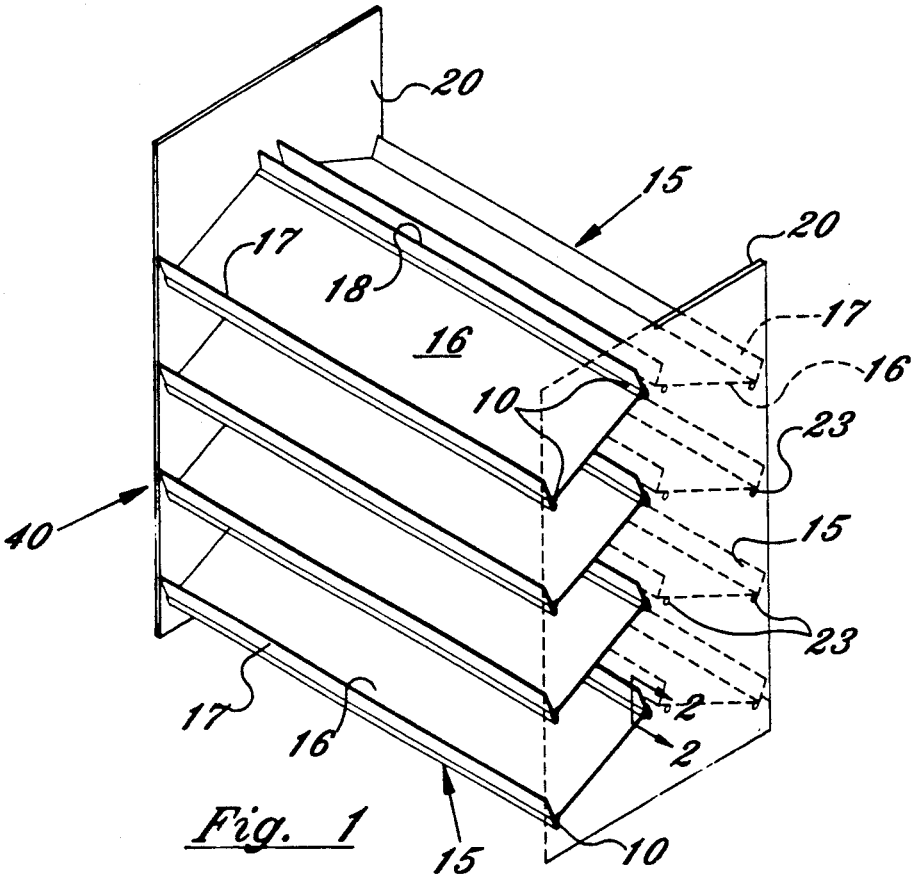
FIG. 1 is an environmental view of a merchandise display cabinet utilizing the invention.
Figure 2:
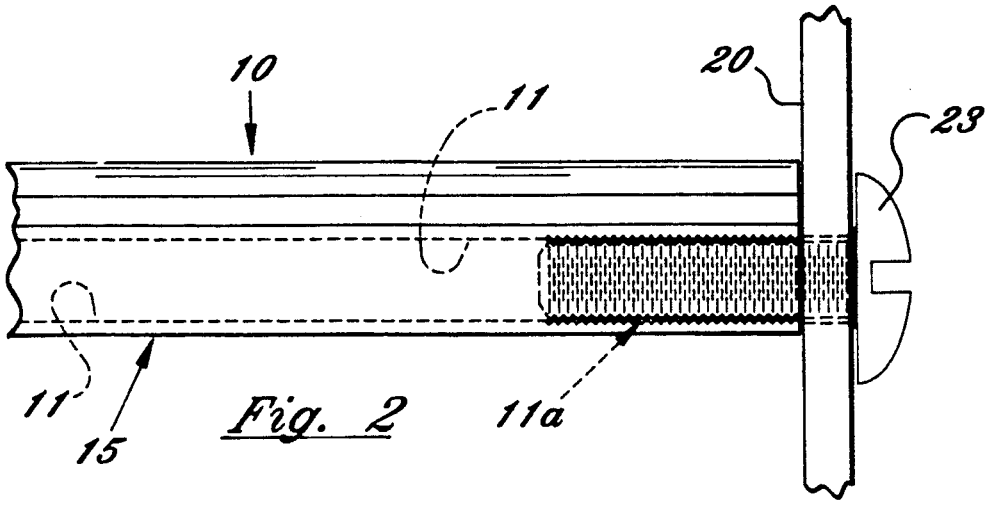
FIG. 2 is an enlarged sectional view taken substantially along the line 2—2 in FIG. 1.

Each planar component of the shelf 15 is integrated with a pair of profiles 10 by positioning the planar components 16, 17, and 18 of the shelf in corresponding channels 12 and 13 of the profiles 10, with the flanges F seated in the grooves 21, as shown in FIG. 3. The assembled shelves 15 extend between and are supported by a pair of end panels 20 to define a display cabinet 40 (FIG. 1). The fastener elements 11A receive bolts 23 penetrating the end panels 20 and threadably embedded in the bores 11 of the profiles 10 (FIG. 2). The integrated three-dimensional shelves 15 have all of the advantages of the prior art monolithic three-dimensional shelves, plus the additional advantage of being readily assembled and disassembled by an unskilled person.

Of course, the profile 10 can be integrated with any appropriately grooved panel by positioning the panel in one of the grooves 12 or 13 and tightening the profile against supporting panels, such as the end panels 20. It is anticipated that other uses of the profile 10 within the scope of the invention as defined herein and in the accompanying claims will occur to those skilled in the art.

Although specific terms have been employed in describing the invention, they have been used in a descriptive and generic sense only and not for the purpose of limitation.

I claim:

1. A shelf assembly comprising at least one three-dimensional shelf and a pair of vertical end panels, said three-dimensional shelf comprising at least two planar components and a pair of profiles, each profile being shaped to define two channels, each channel being shaped to conform with and receive one longitudinal edge of one of the planar components of the shelf, one channel in each profile opening in a selected direction when the shelf assembly is assembled, and the second channel in each profile opening at an angle relative to the one channel, said profiles extending between the end panels, means connecting the two profiles to the end panels, one of said planar components being a base component and another of the planar components being an angular component that extends at an angle to the base component when the shelf assembly is assembled, whereby the base component of the shelf is seated in the channels of both profiles that open in said selected direction and the angular component of the shelf is seated in the angularly opening channel of one profile.

2. A shelf assembly according to claim 1 wherein each shelf includes two angular components, the two angular components being seated in the angularly opening channels of the two profiles.

3. A shelf assembly according to claim 2 wherein each planar shelf component has a groove spaced inwardly from at least one longitudinal edge, and a flange extending inwardly of each channel on the profile, whereby said flange on the profile is seated in said groove in the corresponding shelf component when the corresponding shelf component is positioned in the channel.

4. A shelf assembly according to claim 3 wherein the angularly opening channels extend perpendicularly to the channels opening in a selected direction and wherein the angular components extend perpendicularly to the base component when the shelf assembly is assembled.

5. A shelf assembly according to claim 1 wherein said selected direction is a horizontal direction.

6. A shelf assembly according to claim 5 wherein the angularly opening channel extends perpendicularly to the horizontally opening channel and wherein the angular component extends perpendicularly to the base component when the shelf assembly is assembled.

* * * * *